US007033118B2

(12) United States Patent
Hilfiker

(10) Patent No.: US 7,033,118 B2
(45) Date of Patent: Apr. 25, 2006

(54) COMPRESSIBLE WELDED WIRE RETAINING WALL AND ROCK FACE FOR EARTHEN FORMATIONS

(75) Inventor: Harold K. Hilfiker, Fortuna, CA (US)

(73) Assignee: Hilfiker Pipe Company, Eureka, CA (US)

( * ) Notice: Subject to any disclaimer, the term of this patent is extended or adjusted under 35 U.S.C. 154(b) by 0 days.

(21) Appl. No.: 10/874,943

(22) Filed: Jun. 23, 2004

(65) Prior Publication Data

US 2005/0286980 A1 Dec. 29, 2005

(51) Int. Cl.
*E02D 29/02* (2006.01)

(52) U.S. Cl. ..... 405/262; 405/284

(58) Field of Classification Search ..... 405/262, 405/284, 285, 286

See application file for complete search history.

(56) References Cited

U.S. PATENT DOCUMENTS

| | | | | |
|---|---|---|---|---|
| 4,117,686 A | | 10/1978 | Hilfiker | 405/284 |
| 4,324,508 A | | 4/1982 | Hilfiker et al. | 405/284 |
| 4,329,089 A | | 5/1982 | Hilfiker et al. | 405/262 |
| 4,391,557 A | | 7/1983 | Hilfiker et al. | 405/287 |
| 4,505,621 A | | 3/1985 | Hilfiker et al. | 405/284 |
| 4,643,618 A | | 2/1987 | Hilfiker et al. | 405/287 |
| 4,856,939 A | | 8/1989 | Hilfiker | 405/284 |
| 4,904,124 A | * | 2/1990 | Egan | 405/262 |
| 4,929,125 A | | 5/1990 | Hilfiker | 405/262 |
| 4,961,673 A | | 10/1990 | Pagano et al. | 405/287 |
| 5,076,735 A | * | 12/1991 | Hilfiker | 405/284 |
| 5,494,379 A | * | 2/1996 | Anderson et al. | 405/262 |
| 5,531,547 A | | 7/1996 | Shimada | 405/262 |
| 5,622,455 A | | 4/1997 | Anderson et al. | 405/262 |
| 5,722,799 A | | 3/1998 | Hilfiker | 405/262 |
| 5,733,072 A | | 3/1998 | Hilfiker et al. | 405/284 |
| 6,086,288 A | * | 7/2000 | Ruel et al. | 405/262 |
| 6,357,970 B1 | | 3/2002 | Hilfiker et al. | 405/302.7 |
| 6,857,823 B1 | * | 2/2005 | Hilfiker et al. | 405/262 |

FOREIGN PATENT DOCUMENTS

FR N 75 07114 10/1976

OTHER PUBLICATIONS

Barry R. Christopher, etc., "The Heavy Duty Geogrid Wall," *Civil Engineering*, May 1988, pp. 75-77.

* cited by examiner

*Primary Examiner*—Frederick L. Lagman
(74) *Attorney, Agent, or Firm*—John K. Uilkema; Thelen Reid & Priest LLP

(57) ABSTRACT

A retaining wall and face for an earthen formation is provided by embedding generally horizontally disposed welded wire soil reinforcing mats within the formation at vertically spaced intervals and securing face members between successive soil reinforcing mats at the face of the formation. The soil-reinforcing mats comprise spaced longitudinal elements extending into the formation and spaced transverse elements welded to and extending across the longitudinal elements in a disposition wherein an outer of the transverse elements extends across the face of the formation and an inner of the elements is spaced inwardly of the face. Each face member is secured between successive upper and lower soil-reinforcing mats by extending an upper portion of the face member behind the outer transverse element of the upper soil reinforcing mat and securing an inwardly extending portion of the face member to connection with an inner transverse element of the lower soil reinforcing mat. Wire baskets are disposed to the interior of the face members to contain a layer of rocks at the face of the formation.

20 Claims, 12 Drawing Sheets

COMPRESSIBLE WELDED WIRE RETAINING WALL AND ROCK FACE FOR EARTHEN FORMATIONS

BACKGROUND OF THE INVENTION

The present invention relates to the retention of earthen formations with a retaining and reinforcing mechanism made up of vertically spaced welded wire soil-reinforcing mats embedded within a formation, and face members secured to the mats to secure the formation against sloughing. In its more specific aspects, the invention is directed to an improved method and apparatus which accommodates settling of the earthen formation, without bulging of the face members. It is also concerned with an arrangement wherein the face members comprise welded wire gridworks, and a column of rock is contained in baskets to the interior of these gridworks.

The prior art relating to the present invention is exemplified by U.S. Pat. No. 6,357,970 to Harold K. Hilfiker, one of the co-inventors herein, and William B. Hilfiker. That patent discloses a retaining wall comprised of L-shaped welded wire gridworks having floor sections which are embedded at vertically spaced intervals in the formation being retained and upright face sections which provide a face for the formation. In the structure of the patent, each successive soil-reinforcing mat is supported on a backing mat carried by the face section of the mat therebelow, and the backing mats are movable relative to the face sections to accommodate settlement of the retained formation, without bulging of its face. Other patents of interest to various techniques which have been provided for securing the face sections of compressible welded wire retaining walls together are William K. Hilfiker U.S. Pat. Nos. 4,505,621, 4,856,939, 5,722,799 and 5,733,072.

SUMMARY OF THE INVENTION

The present invention provides a reinforced soil retaining wall for an earthen formation wherein welded wire soil-reinforcing mats are embedded within the formation at vertically spaced intervals and welded wire face members are secured between the mats at the face of the formation. The face members are separate from the mats and so secured thereto as to accommodate settlement of the formation, without bulging. In a preferred embodiment, baskets are provided to the interior of the face members to contain rock at the face of the formation.

The invention also provides an improved face member for securement between successive soil-reinforcing mats. The member comprises an L-shaped body formed with a vertically extending face section and a horizontally extending foot section, which body has prongs extending upwardly from the face section for engagement with a mat disposed thereabove, and hooks extending from the foot section for engagement with a mat disposed therebelow, interiorally of the face of the formation.

A principal object of the present invention is to provide a soil-reinforced retaining wall for an earthen formation, wherein the face members of the wall are separate from the soil-reinforcing elements and so secured thereto that settling of the formation does not result in bulging of the face members.

Another object of the invention is to provide a wire faced retaining wall for a soil-reinforced earthen formation, wherein rock baskets are provided to the interior of the face to contain rock within a relatively narrow vertical column.

Still another object related to the later object is to provide such a wall wherein the face has layered sections and a basket is provided to the interior of each section, with successive baskets being in open communication to provide a continuous rock column over the height of the formation.

Another object of the invention is to provide such a layered wall wherein the uppermost layer of the wall is provided by a wire basket of greater breath than the baskets therebelow, to provide a buttress for the top of the formation.

Still another object of the invention is to provide such a wall wherein the buttress forming basket at the top of the formation is in open communication with the basket therebelow, so that the rock within the buttress forming basket forms part of the column of rock at the face of the formation.

Yet another and more specific object of the invention is to provide a soil-reinforced retaining wall for an earthen formation wherein the soil-reinforcing elements comprise welded wire gridworks and the face members of the wall are separate from the gridworks and connected thereto so as to be compressible, without bulging, and to be secured against outward movement by two transverse wires of each gridwork.

Another and more general object of the invention is to provide a method of forming a soil-reinforced wall for an earthen formation wherein the soil-reinforcing elements comprise welded wire mats and the face of the wall is comprised of welded wire members separate from the mats, with basket structures to the interior thereof containing a column of rocks extending over the height of the wall.

These and other objects will become more apparent from the following detailed description and accompanying drawings.

DESCRIPTION OF THE PREFERRED EMBODIMENT

Structure

Figure 1:
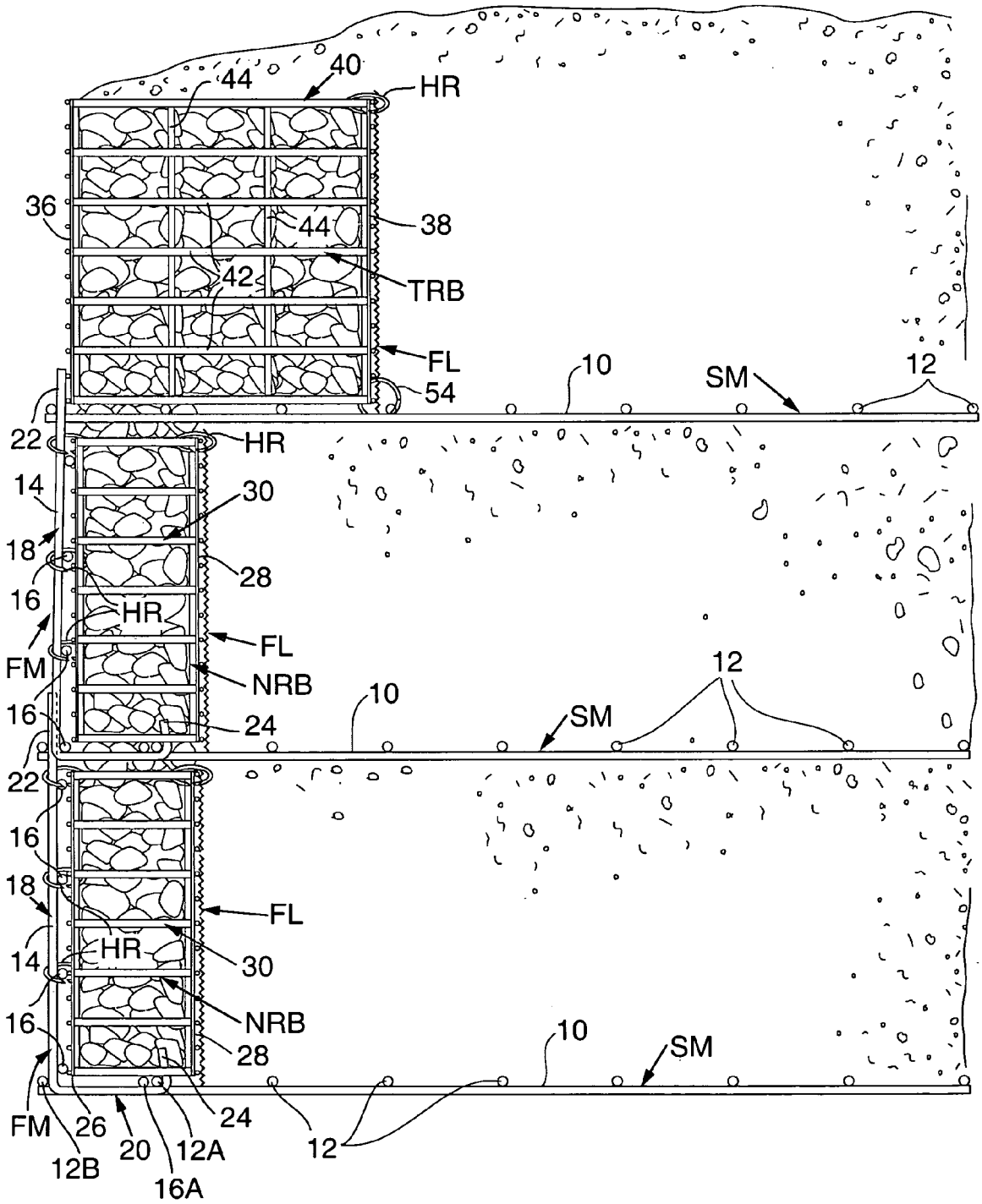
FIG. 1 is a cross-sectional elevational view of a soil-reinforced wall constructed according to the present invention.

Referring now to FIG. 1, the basic elements are soil-reinforcing mats SM, face members FM, narrow rock baskets NRB, top basket TRB, and filter fabric layers FL. Preferably, the mats and face members, as well as all other metallic components are fabricated of steel and coated with a suitable anticorrosive coating, such as zinc.

The soil-reinforcing mats SM and face members FM are of a welded wire construction and typically constructed of W3.5 to W12 wire. The length of the mats SM is determined by the depth of the formation being reinforced. A typical width for the soil-reinforcing mats SM and the face member FM is 8 feet.

A typical height for the face members, as measured between the uppermost and lowermost transverse wires thereof, is 36 inches. Typical dimensions for the narrow rock baskets NRB are 8 feet long by 3 feet high by 1 foot deep. Typical dimensions for the top basket TRB are 8 feet long by 3 feet deep by 3 feet high.

The soil-reinforcing mats SM have longitudinally extending wires 10 with transverse wires 12 extending thereacross, which longitudinal and transverse wires are welded together at their intersections. The face members FM have longitudinal wires 14, with transverse wires 16 extending thereacross at spaced intervals. The longitudinal wires 14 and transverse wires 16 are also welded together at their intersections. Typical spacing for the wires in both the mats SM and the members FM is 8 inches for the longitudinal wires and 21 inches for the transverse wires.

The face members FM are all of the same construction and each comprise a vertically extending face section 18 and a horizontally extending foot section 20. Prongs 22 extend upwardly from the face sections, which prongs are formed by distally extending ends of the longitudinal wires 14. Hooks 24 extend upwardly from the foot sections, which hooks are also formed by distal extensions of the longitudinal wires 14.

Figure 7B:
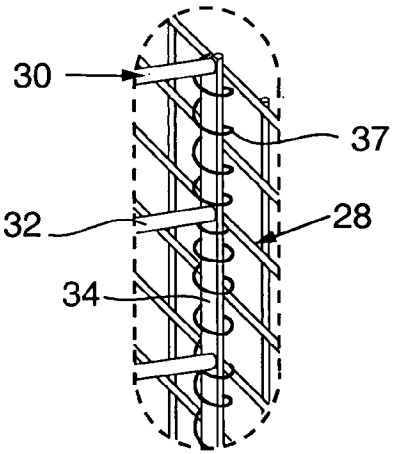
FIGS. 7A and 7B are sectional views taken within the boundaries designated by lines 7A and 7B of FIG. 7.
Figure 7A:
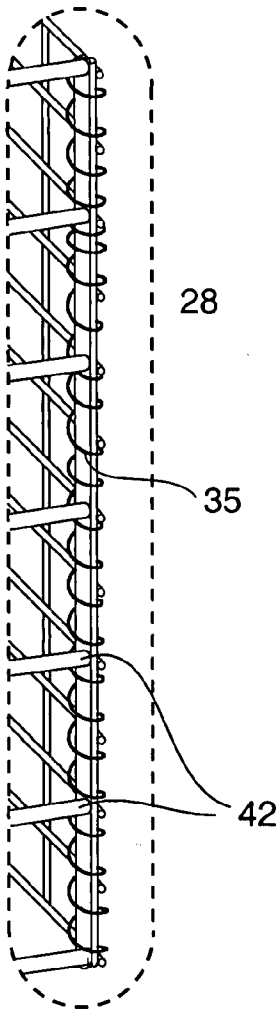

The baskets NRB comprise welded wire front and rear panels 26 and 28, respectively, secured together in spaced relationship by welded wire diaphragms 30. The diaphragms 30 are a frame like construction; comprising horizontal elements 32 welded to vertical elements 34. Spiral connectors 35, 37 (see FIGS. 7A and 7B) hingedly secure the diaphragms to the front and rear panels. The mesh of the front and rear panels is sufficiently small to prevent fill rock from passing therethrough. The horizontal elements 32 are sufficiently spaced so as to not impede the passage of rock therethrough. The baskets NRB are open at the top and bottom so that rock may pass therethrough.

The top basket TRB is of a construction similar to the narrow baskets NRB, except for its depth. It comprises front and rear panels 36 and 38, respectively, and connecting diaphragms 40. The diaphragms 40 comprise horizontal elements 42 welded to intersecting vertical elements 44. The front and rear panels are hingedly secured to the diaphragms by spiral connectors 35, 37 corresponding to those used for the baskets NRB. A lid 48 is hingedly secured to the top of the basket TRB by a spiral connector 50 (see FIG. 2A). The lid is comprised of intersecting welded wires and, upon filling of the basket TRB with rock, is secured in closed condition by a spiral connector 52 (see FIG. 2).

Assembly

The assembly sequence for constructing a wall according to the present invention is diagrammatically illustrated in FIGS. 3A through 3H.

Figure 3A:
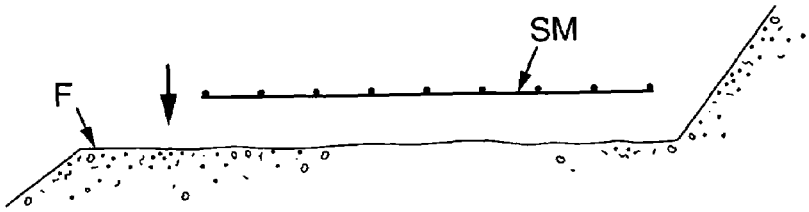
FIGS. 3A, 3B, 3C, 3D, 3E, 3F, 3G and 3H are diagrammatic views, in elevational cross-section, schematically illustrating the successive steps for constructing a soil-reinforced retaining wall according to the present invention.

FIG. 3A shows the first step of the assembly process wherein a foundation F has been formed at the foot of the formation over which the soil-reinforced wall is to be constructed. As there shown, the top of the foundation is generally horizontal and the first soil-reinforcing mat SM is in the process of being placed.

Figure 3B:
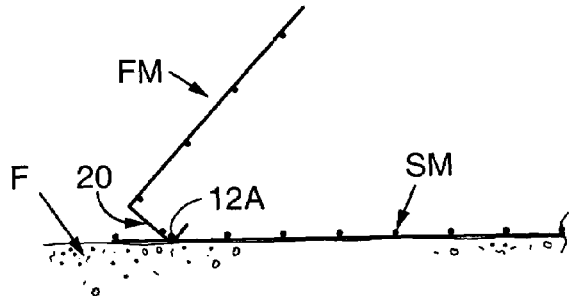
Figure 4:
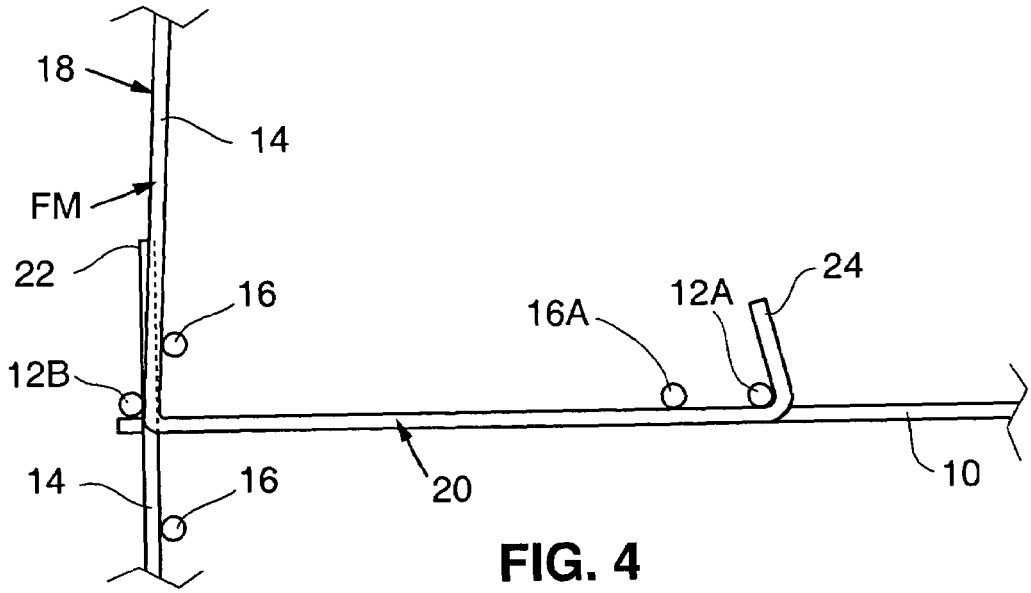
FIG. 4 is a cross-sectional elevational view, with parts thereof broken away, illustrating the inventive connection between the face member foot section and the soil-reinforcing mat, as the connection appears before compression of the face member.
Figure 5:
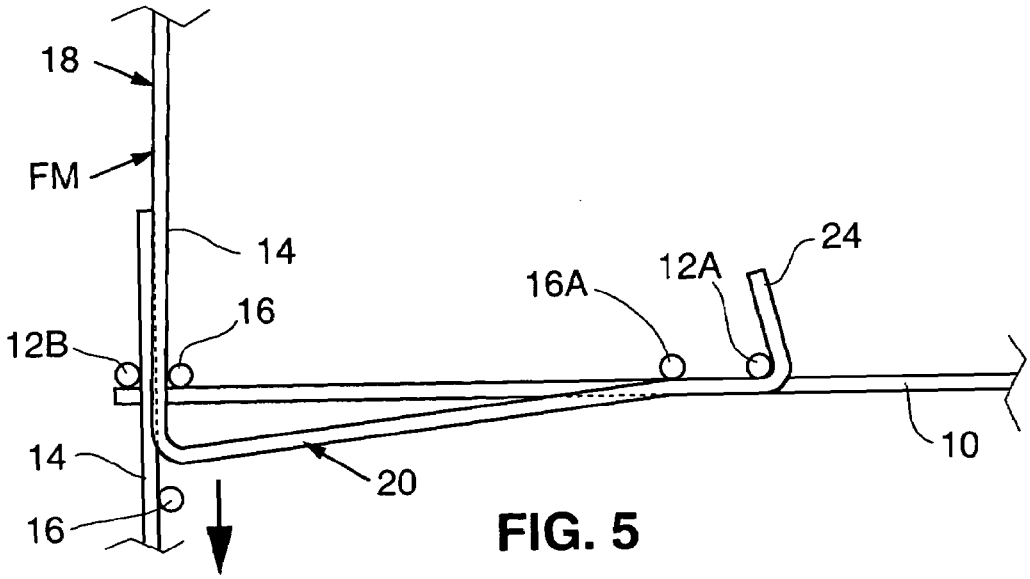
FIG. 5 is a cross-sectional elevational view, similar to FIG. 4, illustrating the inventive connection between the face member foot section and the soil-reinforcing mat, as the connection appears after compression of the face member.
Figure 6:
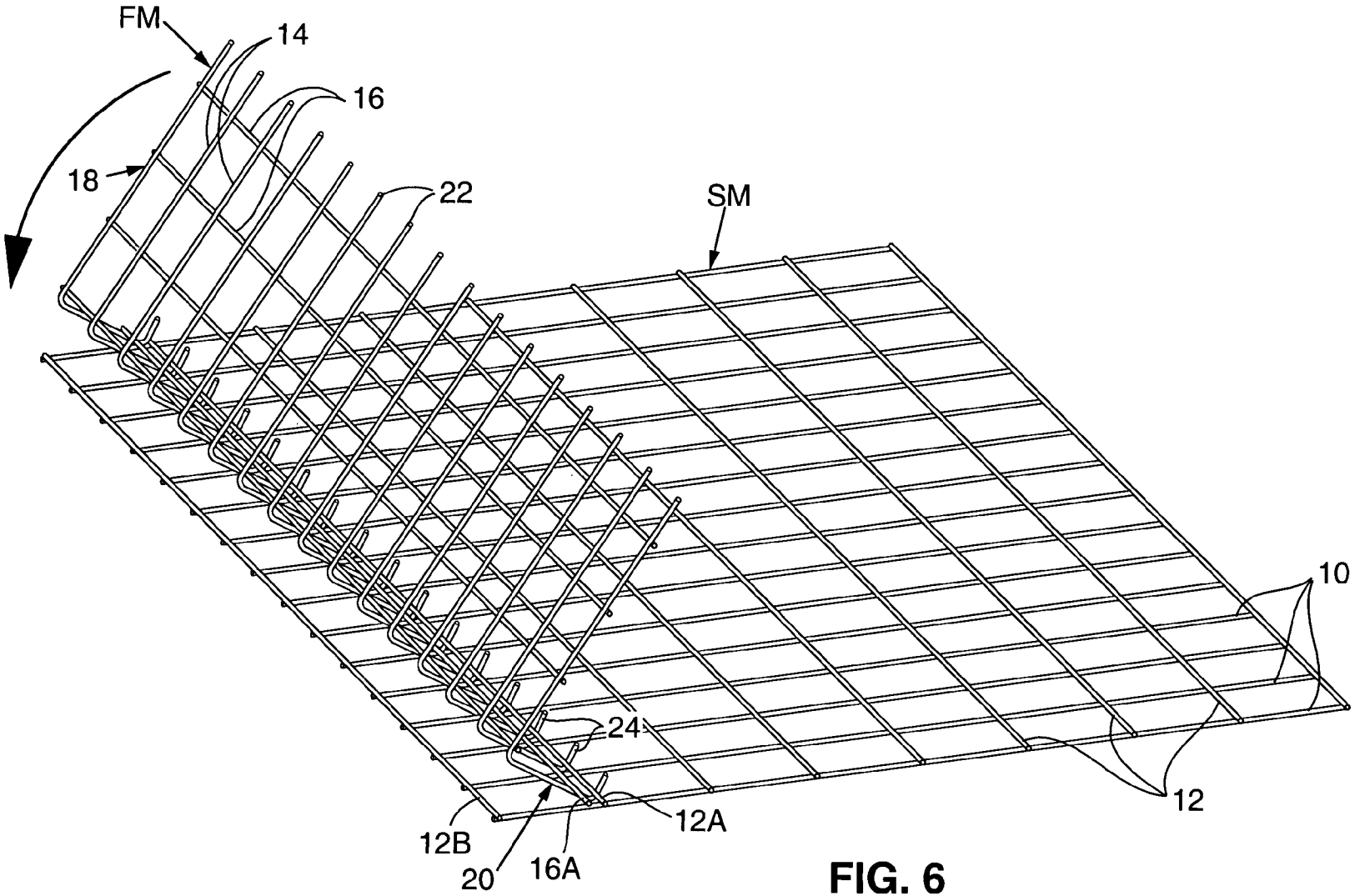
FIG. 6 is a perspective view, illustrating a face member according to the present invention, in the process of being connected to the soil-reinforcing mat disposed therebelow.
Figure 7:
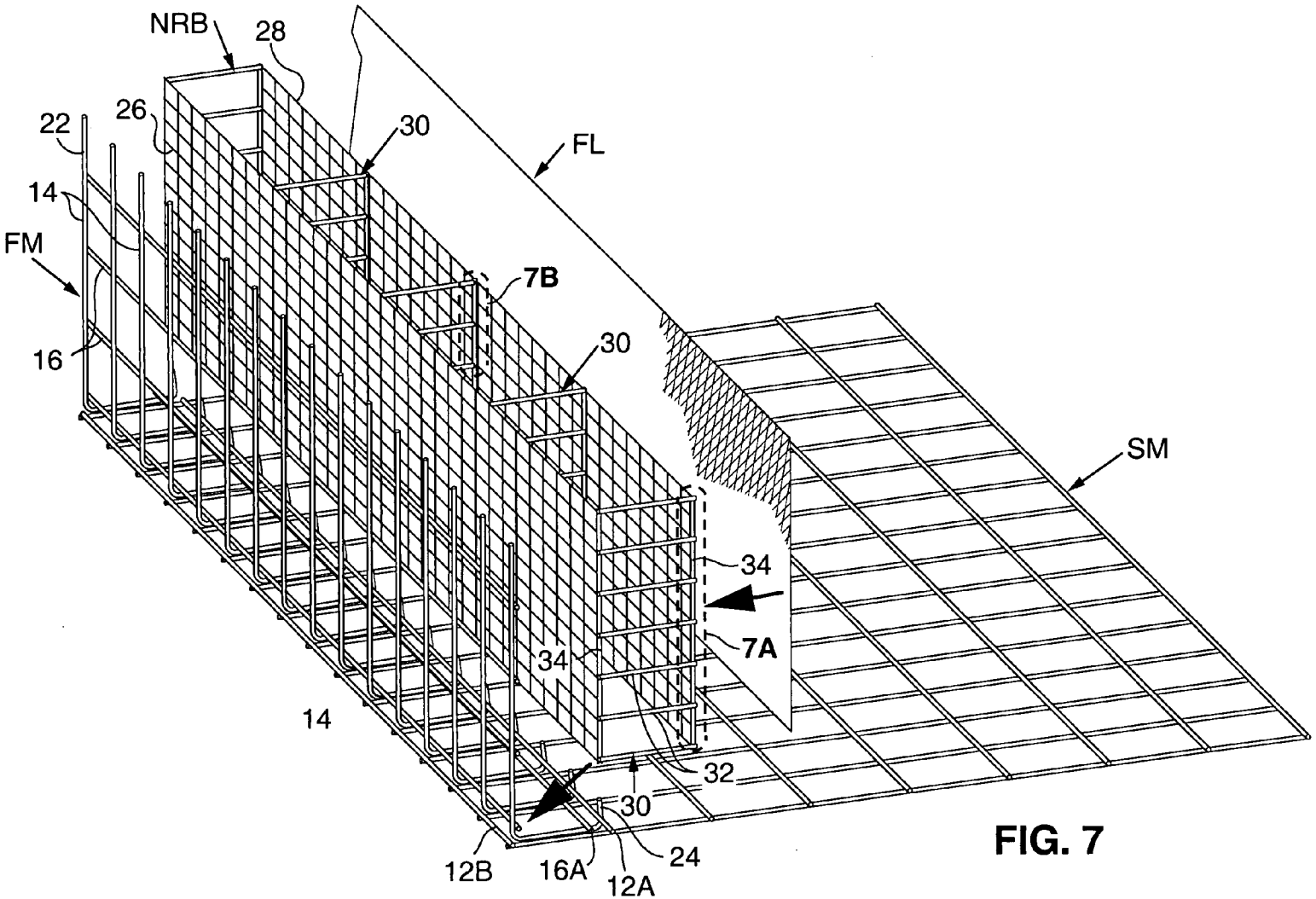
FIG. 7 is an exploded perspective view, illustrating a basket and filter fabric layer being assembled into place behind the face member of the invention.
Figure 8:
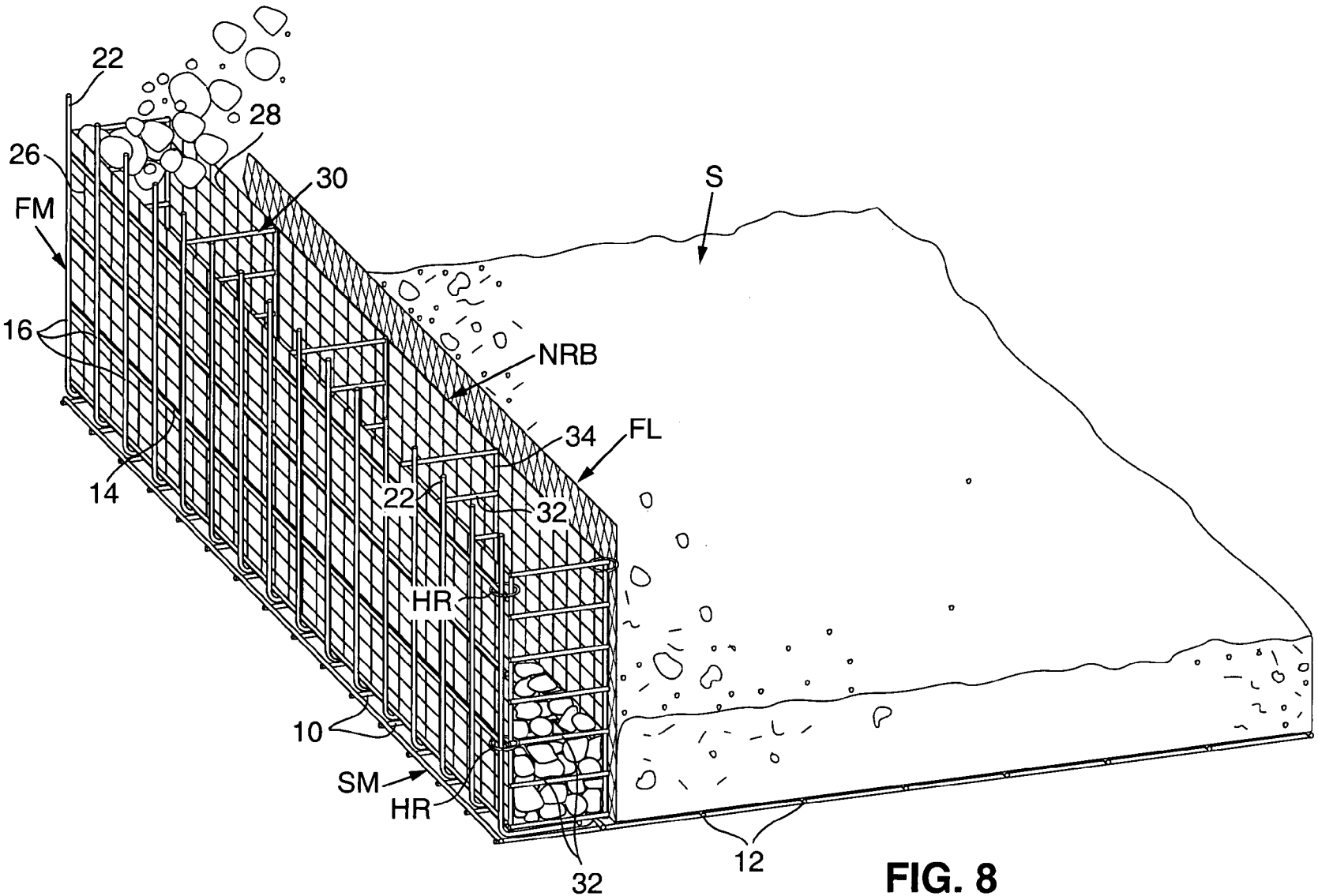
FIG. 8 is a perspective view, with parts thereof broken away, illustrating the face member and basket of the invention engaged with a soil-reinforcing mat therebelow, with a partial layer of rock and backfill in place.

FIG. 3B shows step 2 of the assembly process wherein the foot section 20 of the first face member FM is being secured to the lowermost soil-reinforcing mat SM. This step is shown in more detail in FIGS. 6 and 7, wherein it will be seen that the hooks 24 are engaged beneath a transverse wire 12A spaced one inwardly from the outermost transverse wire 12B, and that the face member is then swung downwardly so that section 18 thereof is in a vertical disposition. In the later condition, the transverse wire 16A of the foot section 20 rests on the longitudinal wires 10 of the soil-reinforcing mat, and the face section 18 is disposed to the interior of the outermost transverse wire 12B of the soil-reinforcing mat (see FIG. 4). As a result, the face member is secured against outward displacement by both the wire 12A and the wire 12B. This has the advantage that the connection between the soil-reinforcing mat and the face member is not dependent upon the integrity of a single transverse wire of the soil-reinforcing mat. At the same time, however, the face member may slide downwardly relative to the wire 12B, as shown in FIG. 5. The provision of such downward movement permits the face member to compress, as may result from settlement of the earthen formation being retained, without bulging.

Figure 3C:
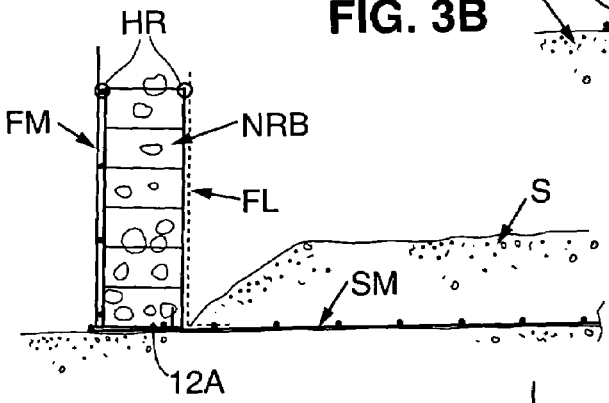

FIG. 3C shows the third step of the assembly technique wherein baskets NRB are placed to the interior of the first course of face members FM and filter fabric layer FL is disposed over the interior of the baskets. This assembly step may be seen, in more detail, in FIG. 7. During the course of the assembly process, hog rings HR are secured between the baskets, face members and filter fabric layers. Such hog rings are shown at the top of FIG. 3C. While the hog rings provide a relatively secure connection, they may bend and release as the earthen formation settles.

The step of FIG. 3C also includes backfilling and compacting soil to the interior of the basket NRB to a level of approximately 12 inches, and then filling the baskets NRB with rock to level of approximately 18 inches. This process is continued by successively backfilling and compacting additional layers of soil behind the lower most level of baskets NRB, as depicted in FIGS. 3D and 3E.

Figure 3D:
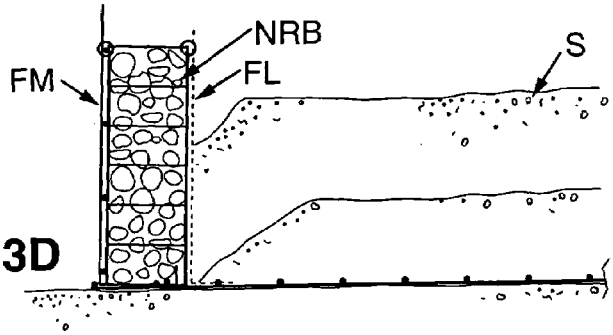
Figure 9:
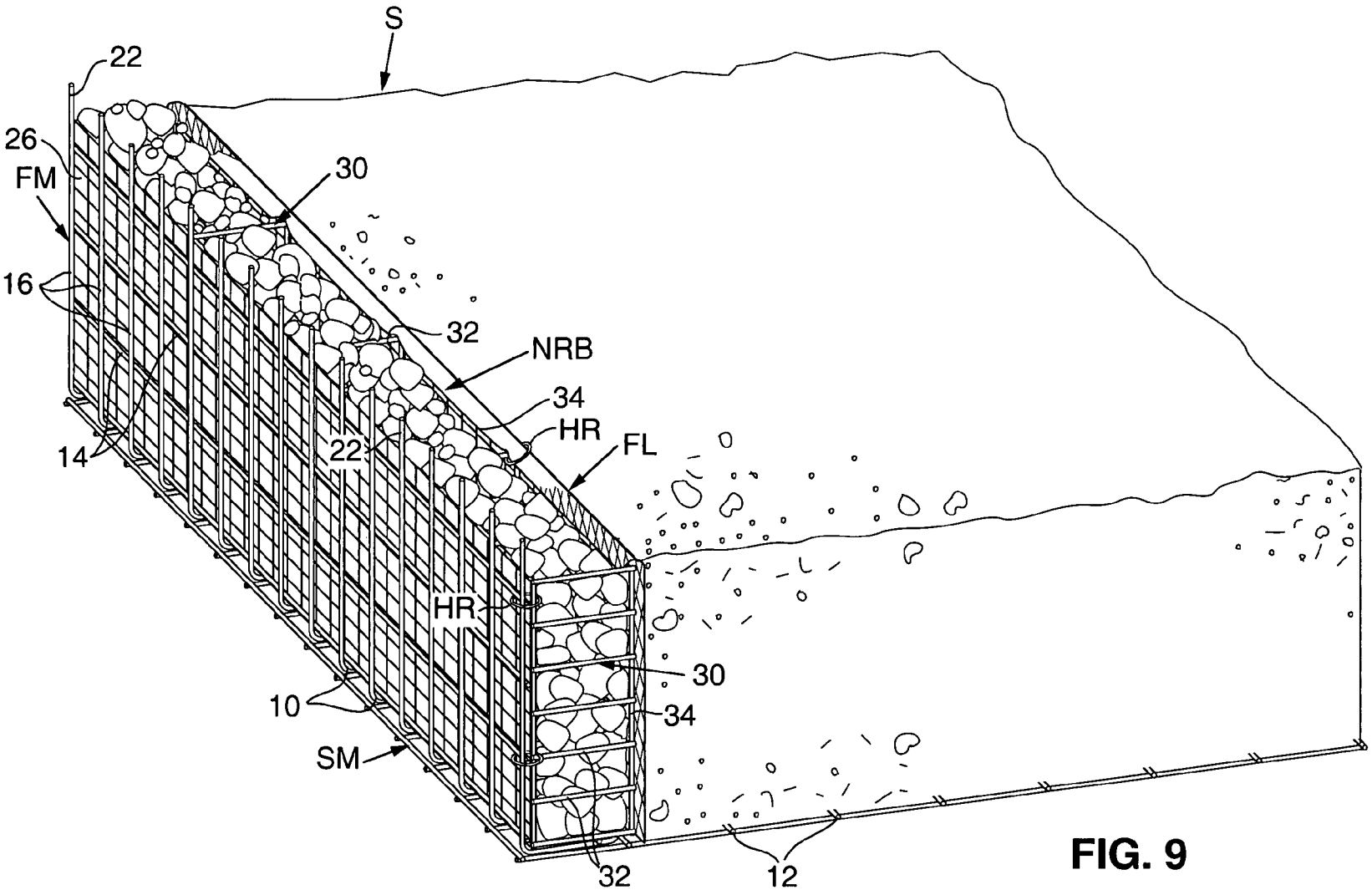
FIG. 9 is a perspective view, with parts thereof broken away, illustrating the face member and basket of the invention engaged with a soil-reinforcing mat therebelow, with a full layer of rock and backfill in place; and, FIG. 10 is a diagrammatic perspective view, illustrating the spanning relationship of the rock baskets relative to the face members.

In the step of FIG. 3D, soil is backfilled and compacted to a level of approximately 24 inches and the basket NRB is filled to its upper level. FIG. 3E shows the next step wherein soil is backfilled and compacted to the upper level of the first layer of baskets. This may be seen, in more detail, in FIG. 9.

Figure 2:
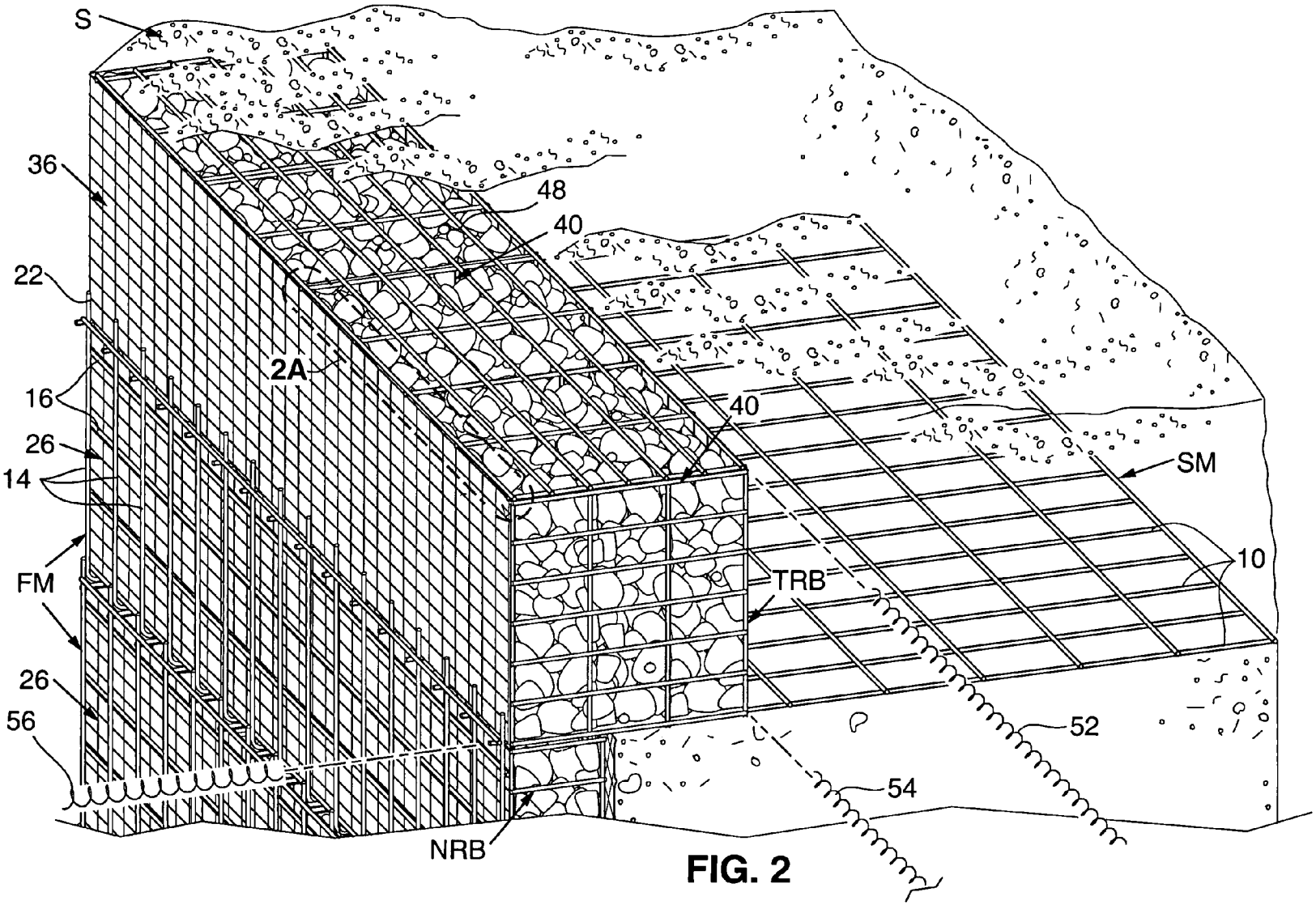
FIG. 2 is a perspective view of the wall shown in FIG. 1, with parts thereof broken away.
Figure 3E:
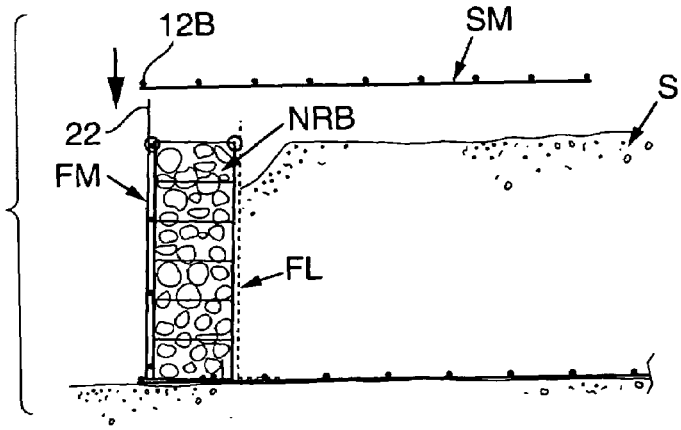

The step of FIG. 3E also includes placing the next lift of soil-reinforcing mats SM over the backfill soil so that the outermost transverse wires 12B of the mats extend across the face members FM to the exterior of the prongs 22. Through the later interrelationship, as may be seen from the step of FIG. 3F, the second lift of soil-reinforcing mats serves to secure the upper ends of the face members therebelow, against outward displacement, while permitting the members to slide downwardly. This interrelationship is shown in larger detail in FIGS. 4 and 5. It also may be seen from FIGS. 1 and 2.

Figure 3F:
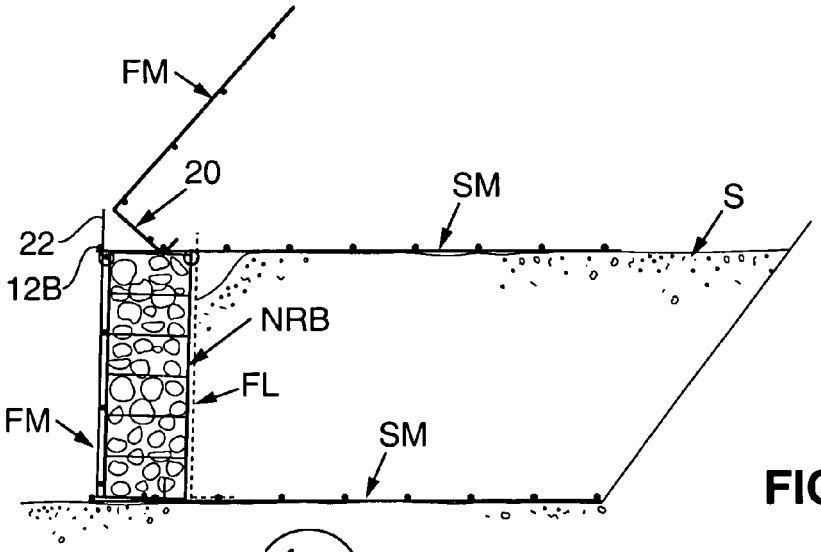
Figure 3G:
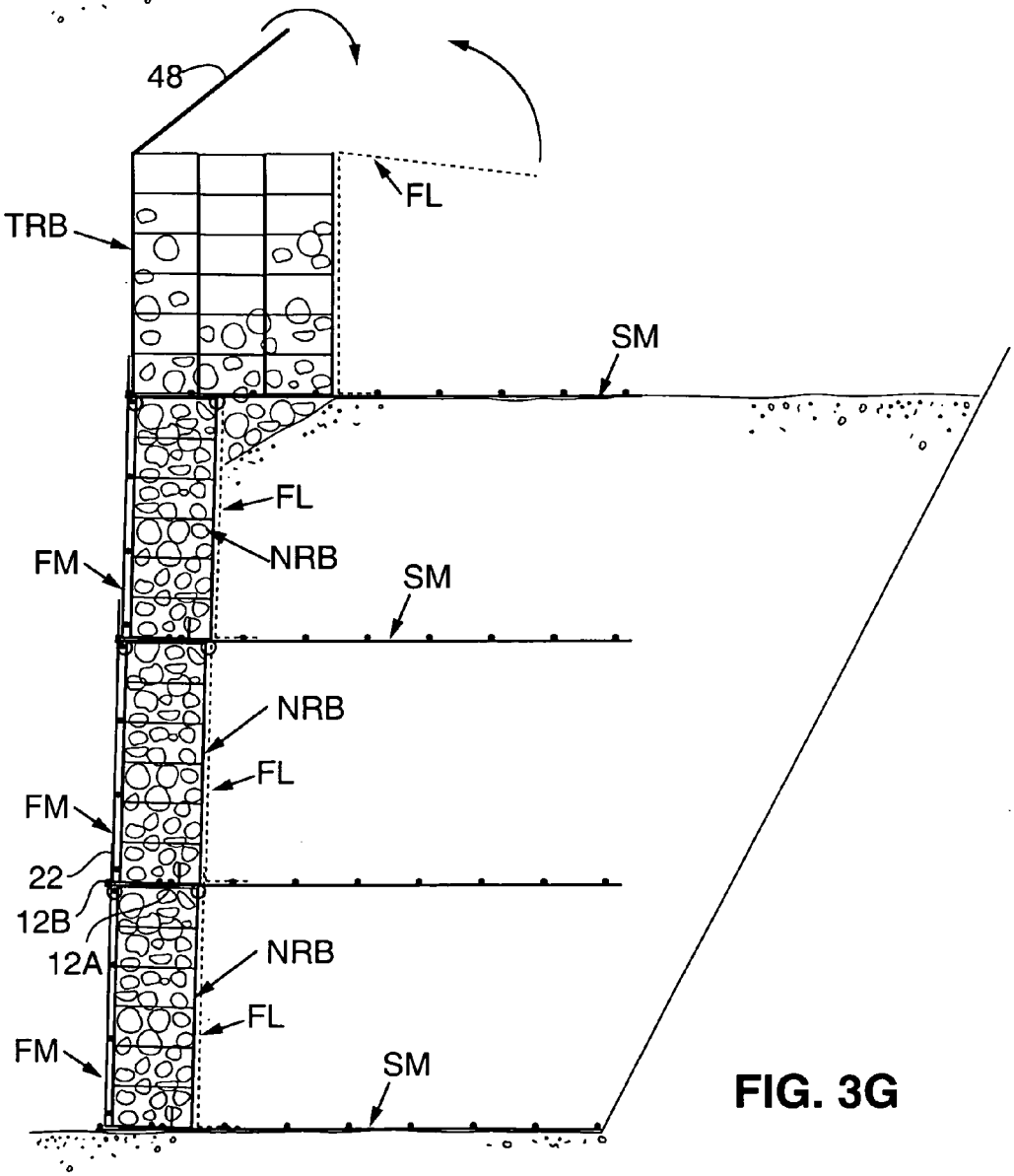

FIG. 3F shows the placement of the next course of face members FM over the soil-reinforcing mats supported on the first level of backfill. This placement corresponds to that described with reference to FIGS. 3B and 6. It is completed by swinging the face member so that its face section 18 is near-vertical. Thereafter, the steps depicted in FIGS. 3C, 3D and 3E are repeated until the wall reaches the lower level of the top lift, as seen in FIG. 3G.

Upon reaching the later level, the top basket TRB is placed on the top most soil-reinforcing mat SM so that the outside surface of the basket is to the interior of the prongs 22 of the face member immediately therebelow. The lower innermost corner of the basket TRB is preferably spiral connected to the soil-reinforcing mat. Backfill soil is then placed and compacted behind the basket TRB in successive 12 inch lifts as the basket TRB is filled with rock, until the backfill reaches the level of the top of the basket TRB. At this point, the rear top edge of the lid 48 is secured in the closed condition by spiral connectors or hog rings. Thereafter, the filter fabric layer FL to the interior of the basket NRB is wrapped over the top of the basket, as may be seen from FIG. 3H.

Figure 3H:
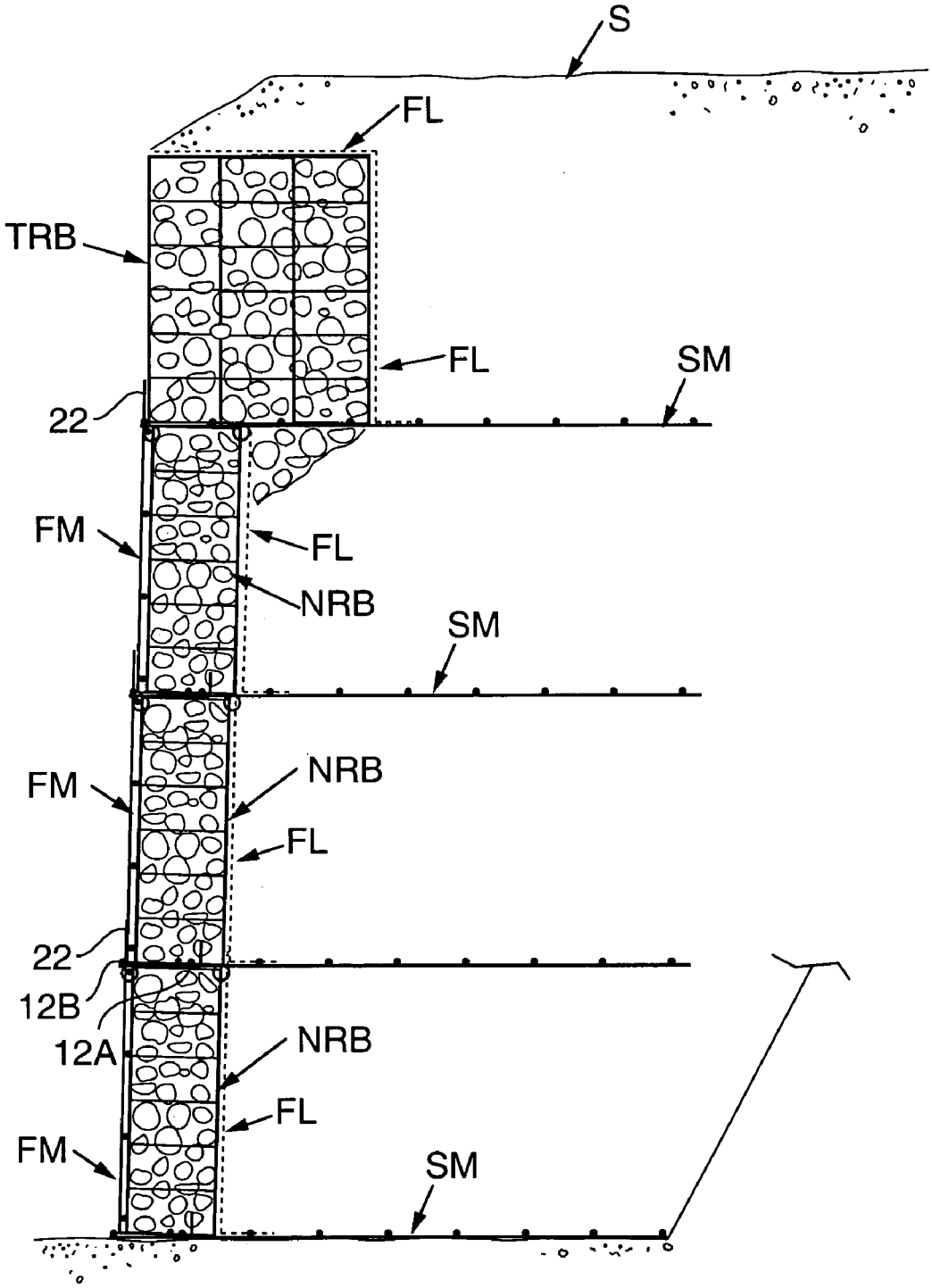

The final step, in the completed wall, is shown in FIG. 3H. As there illustrated, the backfill has been placed and compacted to final grade. This condition is also seen in FIG. 1.

Figure 2A:
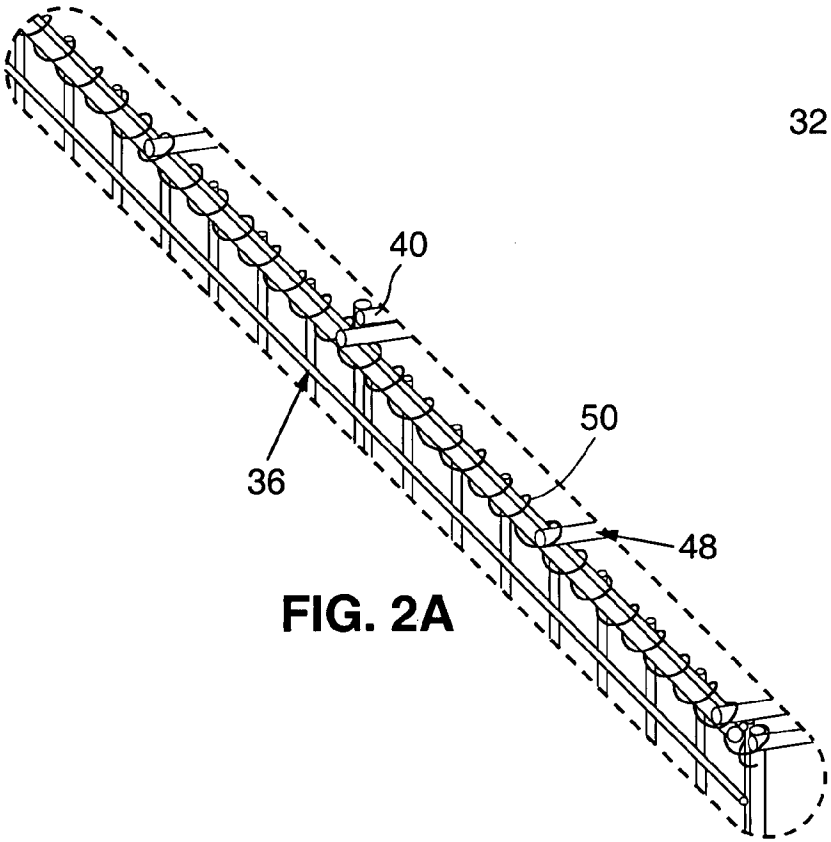
FIG. 2A is a sectional view taken within the boundary designated by line 2A of FIG. 2.

The spiral connector securing the basket TRB to the top of the soil-reinforcing mat SM therebelow is depicted by the numeral 54, and may be seen from FIG. 2. This figure also illustrates how spiral connectors 56 may be used to secure the basket TRB to the longitudinal wires of the soil-reinforcing mat SM.

Figure 10:
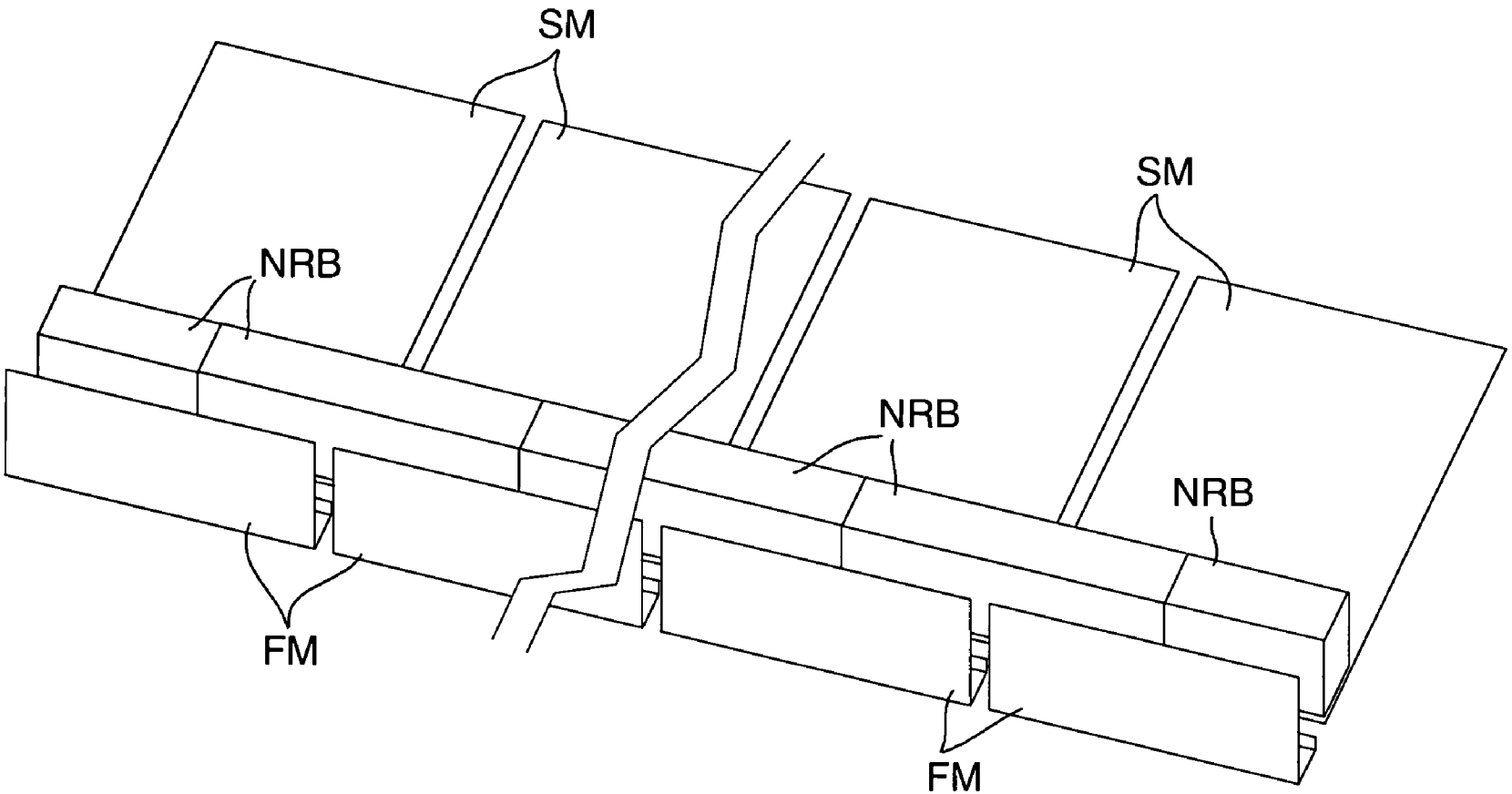

FIG. 10 shows one level of a wall comprised of four face members FM and spanning baskets NRB. This staggered arrangement of baskets and face members insures against sloughing between the face members. All levels of the wall beneath the basket TRB are so constructed.

Operation

The wall of the present invention functions to both reinforce the earthen formation and to secure its face against sloughing. Reinforcement is provided by the soil-reinforcing mats SM. Securing on the face against sloughing is provided by the face members FM and the column of rock to the interior thereof provided by the baskets NRB and TRB. These baskets are open to one another and, thus, provide a continuous column of rock at the face of the retained formation. The filter fabric layer FL contains the backfill soil to the interior of the baskets.

In the event of settling of the earthen formation, the face members FM may move downwardly, as seen in FIG. 5. Such downward movement is provided by the slidable interrelationship between the prongs 22 and the wires 12B at the top of each face member and the slidable interrelationship between the longitudinal wires 14 and the outermost wires 12B at the bottom of each face member. During such settlement, the face members continue to be secured against outward displacement by both the transverse wires 12A and 12B of the soil-reinforcing mats. The transverse wire 16A of each face member maintains the hook in engagement with the wire 12A, with the result that downward compression of the face member functions to bend the longitudinal wires in the foot section of the member downwardly, as seen in FIG. 5.

CONCLUSION

From the foregoing description, it believed apparent that the present invention enables the attainment of the objects initially set forth herein. In particular, it provides a soil reinforced wall with a rock face wherein the face retaining elements of the wall may accommodate settlement of the earthen formation, without bulging. The number of lifts in the wall may vary, without departing from the invention. The three lift embodiment shown in FIGS. 1 and 2, and the four lift embodiment shown in FIG. 3H, are simply examples. The invention is not intended to be limited by the specifics of the illustrated embodiments, but rather as defined by the accompanying claims.

The invention claimed is:

1. A retaining wall for reinforcing an earthen formation and securing a face of the formation against sloughing, said wall comprising:

a. successive, generally horizontally disposed, welded wire soil-reinforcing mats embedded within the formation at vertically spaced intervals, each of said mats having:

i. spaced longitudinal elements extending into the formation; and, ii. transverse elements welded to and extending across the longitudinal elements at spaced intervals, with an outer of said transverse elements extending across the face of the formation and an inner of said transverse elements spaced inwardly of the face;

b. a welded wire face member extending over the face of the formation between successive upper and lower soil-reinforcing mats, said face member being separate from the upper and lower soil-reinforcing mats;

c. an upwardly extending projection on the face member engaged with and disposed interiorly of the outer transverse element of the upper soil-reinforcing mat; and, d. an inwardly extending projection on the face member connected to the inner transverse element of the lower soil-reinforcing mat.

2. A retaining wall according to claim 1, wherein:

a. a hook is formed on the inwardly extending projection: and, b. the inwardly extending projection is connected to the inner transverse element of the lower soil-reinforcing mat by engagement of the hook with said inner transverse element.

3. A retaining wall according to claim 2, wherein:

a. the inwardly extending projection has a transverse element engaged over the longitudinal elements of the lower soil-reinforcing mat; and, b. the hook extends beneath and hooks around the inner transverse element of the lower soil-reinforcing mat.

4. A retaining wall according to claim 2 wherein the upwardly extending projection comprises prongs extending distally from the face member.

5. A retaining wall according to claim 4 wherein the face member has an upper transverse element disposed for engagement by the upper soil-reinforcing mat as the earthen formation settles.

6. A retaining wall according to claim 1, further comprising a wire basket disposed interiorly of and engaged with the face member, said basket containing rock and extending over the face member between the upper and lower soil-reinforcing mats.

7. A retaining wall according to claim 1 wherein:

a. the face member extends interiorly of the outer transverse element of the lower soil-reinforcing mat; and, b. the inwardly extending projection is so connected to the inner transverse element of the lower soil-reinforcing mat as to maintain the face member interiorly of and closely adjacent to the outer transverse element of the lower soil-reinforcing mat as the earthen formation settles.

8. A retaining wall for reinforcing an earthen formation and securing a face of the formation against sloughing, said wall comprising:

a. successive, generally horizontally disposed, welded wire soil-reinforcing mats embedded within the formation at vertically spaced intervals, each of said mats having:

i. spaced longitudinal elements extending into the formation; and, ii. transverse elements welded to and extending across the longitudinal elements at spaced intervals, with an outer of said transverse elements extending across the face of the formation;

b. a first welded wire face member extending over the face of the formation between first and second successive soil-reinforcing mats, said first face member being separate from the first and second soil-reinforcing mats;

c. means securing the first face member interiorly of the outer transverse elements of the first and second soil-reinforcing mats, said means permitting vertical movement of the first face member relative to at least one of the first and second soil-reinforcing mats to accommodate settling of the earthen formation; and, d. a first wire basket disposed interiorly of and in engagement with the first face member, said first basket containing rock and extending over the first face member between the first and second soil-reinforcing mats.

9. A retaining wall according to claim 8, further comprising:

a. a second welded wire face member extending over the face of the formation between the second soil-reinforcing mat and a successive third soil-reinforcing mat above the second soil-reinforcing mat; and, b. a second wire basket disposed interiorly of and in engagement with the second face member, said second basket containing rock and extending over the second face member between the second and third soil-reinforcing mats.

10. A retaining wall according to claim 9 wherein the first and second baskets are open to one another.

11. A retaining wall according to claim 9, further comprising an uppermost wire basket resting on the third soil-reinforcing mat, said uppermost basket containing rock and having a face generally coextensive with the second face member.

12. A retaining wall according to claim 11, wherein the uppermost basket has a bottom open to the second basket.

13. A retaining wall according to claim 12, wherein the uppermost basket is closed by a cover.

14. A method for reinforcing an earthen formation and securing a face of the formation against sloughing, said method comprising:

a. embedding generally horizontally disposed, welded wire soil reinforcing mats within the formation at vertically spaced intervals, each of said mats having:

i. spaced longitudinal elements extending into the formation; and, ii. transverse elements welded to and extending across the longitudinal elements at spaced intervals, with an outer of said transverse elements extending across the face of the formation and an inner of said transverse elements spaced inwardly of the face;

b. positioning a first welded wire face member over the face of the formation between successive upper and lower soil-reinforcing mats, said first face member being separate from the upper and lower soil-reinforcing mats;

c. securing the first face member in place by the steps of:

i. providing an upwardly extending projection on the first face member and engaging the upwardly extending projection interiorly of the outer transverse element of the upper soil-reinforcing mat; and, ii. providing an inwardly extending hooked projection on the first face member and engaging the hooked projection with the inner transverse element of the lower soil-reinforcing mat.

15. A method according to claim 14, further comprising positioning a first wire basket interiorly of and in engagement with the first face member, said first basket containing rock and extending over the first face member between the lower and upper soil-reinforcing mats.

16. A method according to claim 14, further comprising:

a. positioning a second welded wire face member over the face of the formation between the upper soil-reinforcing mat and a next successive uppermost soil reinforcing mat thereabove, said second face member being separate from the upper and uppermost soil-reinforcing mats;

b. securing the second face member in place by the steps of:

i. providing an upwardly extending projection on the second face member and engaging the upwardly extending projection of the second face member interiorly of the outer transverse element of the uppermost soil-reinforcing mat; and, ii. providing an inwardly extending hooked projection on the second face member and engaging the hooked projection with the inner transverse element of the upper soil-reinforcing mat.

17. A method according to claim 16, further comprising:

a. positioning a first wire basket interiorly of and in engagement with the first face member, said first basket containing rock and extending over the first face member between the lower and upper soil-reinforcing mats; and, b. positioning a second wire basket interiorly of and in engagement with the second face member, said second basket containing rock and extending over the second face member between the upper and uppermost soil-reinforcing mats.

18. A method according to claim 17, further comprising positioning an uppermost wire basket on the uppermost soil-reinforcing mat, said uppermost basket containing rock and having a face generally coextensive with the second face member.

19. A retaining wall for reinforcing an earthen formation and securing a face of the formation against sloughing, said wall comprising:

a. a first generally horizontally disposed, welded wire soil-reinforcing mat embedded within the formation, said mat having:
   i. spaced longitudinal elements extending into the formation; and,
   ii. transverse elements welded to and extending across the longitudinal elements at spaced intervals;
b. a welded wire face member extending over the face of the formation, said face member being separate from the first soil-reinforcing mat and have a lower portion secured to the first soil reinforcing mat to hold the face mat against outward displacement relative to the earthen formation and permit vertical movement of the face mat relative to the first soil reinforcing mat to accommodate settlement of the earthen formation;
c. means securing and upper portion of the face member against outward displacement relative to the earthen formation; and,
d. a wire basket disposed interiorly of and in engagement with the face member, said basket containing rock and being generally coextensive with the face member.

20. A retaining wall according to claim 19 wherein the means comprises:

a. a second generally horizontally disposed, welded wire soil reinforcing mat disposed within the formation in upwardly spaced relationship to the first soil reinforcing mat, said second reinforcing mat having:
   i. spaced longitudinal elements extending into the formation; and,
   ii. transverse elements welded to and extending across the longitudinal elements at spaced intervals, with an outer of said transverse elements extending across the face of the formation;
b. an upwardly extending projection on the face member engaged interiorly with the outer transverse element of the second soil-reinforcing mat for slidable movement to accommodate settlement of the earthen formation.

* * * * *